US007607479B2

(12) United States Patent
Cognata

(10) Patent No.: US 7,607,479 B2
(45) **Date of Patent: *Oct. 27, 2009**

(54) THREE PHASE DOWNHOLE SEPARATOR APPARATUS AND PROCESS

(76) Inventor: Louis J. Cognata, 15002 Lakeview Dr., Baytown, TX (US) 77520

( * ) Notice: Subject to any disclaimer, the term of this patent is extended or adjusted under 35 U.S.C. 154(b) by 173 days.

This patent is subject to a terminal disclaimer.

(21) Appl. No.: 11/974,150

(22) Filed: Oct. 11, 2007

(65) Prior Publication Data

US 2008/0035336 A1 Feb. 14, 2008

Related U.S. Application Data

(63) Continuation-in-part of application No. 11/140,305, filed on May 31, 2005, now Pat. No. 7,255,167, and a continuation-in-part of application No. 11/825,369, filed on Jul. 6, 2007, now Pat. No. 7,389,816.

(60) Provisional application No. 60/598,471, filed on Aug. 3, 2004, provisional application No. 60/860,774, filed on Nov. 21, 2006.

(51) Int. Cl.
*E21B 43/38* (2006.01)
*E21B 43/40* (2006.01)

(52) U.S. Cl. ..... 166/265; 166/105.5; 166/106; 166/369

(58) Field of Classification Search ..... 166/265, 166/105, 106, 369, 370, 105.5
See application file for complete search history.

(56) References Cited

U.S. PATENT DOCUMENTS 7,389,816 B2 * 6/2008 Cognata ..... 166/265

* cited by examiner

*Primary Examiner*—Giovanna C Wright
(74) *Attorney, Agent, or Firm*—Michael Locklar; Jackson Walker LLP

(57) ABSTRACT

Three phase separator systems for separating mixtures downhole are provided that utilize fluid isolation devices or packers to allow sections of casing to separate water, oil, and gas through gravity separation. By utilizing two or more vertical sections of a downhole casing, gravity separation of multiple phases may be accomplished. For example, one vertical section of casing may be used to allow the gravity separation of a liquid mixture and a gas therein while a second vertical section of casing may be used to separate the liquid mixture into a water phase and an oil phase. Numerous other components such as pumps, piping, and valves may form part of the separation system depending on the particular embodiment.

19 Claims, 6 Drawing Sheets

THREE PHASE DOWNHOLE SEPARATOR APPARATUS AND PROCESS

CROSS-REFERENCE TO RELATED APPLICATIONS

This patent application is a continuation-in-part of U.S. patent application Ser. No. 11/140,305, now U.S. Pat. No. 7,255,167 (filed on May 31, 2005) and of U.S. patent application Ser. No. 11/825,369 (filed on Jul. 6, 2007) now U.S. Pat. No. 7,389,816, both of which claim priority to U.S. Provisional Patent Application Ser. No. 60/598,471 filed Aug. 3, 2004, all three of which are hereby incorporated by reference. This patent application is also a continuation-in-part of and claims priority to U.S. Provisional Patent Application Ser. No. 60/860,774 filed Nov. 21, 2006, which is hereby incorporated by reference.

BACKGROUND

The present invention generally relates to devices and processes for downhole separation of mixtures of water, oil, and gas within well bores.

In hydrocarbon production from subterranean formations, a production stream generally contains crude oil and/or hydrocarbon gases as the principal valuable products. Nevertheless, depending on the production well, water is often mixed in with valuable production streams. Water may be naturally present in a formation and may be present due to secondary recovery operations to enhance recovery of oil and gas such as artificial steam injection into the formation. Often, the water and oil will be present in the production stream as an oil-in-water emulsion (i.e. the water forms a continuous phase and the oil a dispersed phase) or a water-in-oil emulsion (i.e. the oil forms a continuous phase and the water is a dispersed phase). Furthermore, gas, when present, may exist as a separate dispersed phase (i.e. as bubbles). Some of the gas will normally be dissolved in the liquid phases, the amount of dissolved gas varying according to the temperature and pressure of the stream at any point in question.

Thus, mixtures of oil, water, and various gases are often encountered in subterranean formations. Typically, these phases are separated uphole after extracting the production streams to the surface. Numerous methods of three phase separation are used including the use of uphole separation equipment such as flash drums, gravity separators, and cyclonic separators.

Flash drums are vessels into which a stream is reduced in pressure sufficiently to flash gases from a liquid stream. Gravity separators are essentially vessels or drums into which a mixture is introduced and allowed to settle. Gravity causes the denser water phase to settle to form a layer at the bottom of the separator, and the less dense oil phase to form a liquid layer on top of the water layer. Hydrocarbon gas, if present as a dispersed phase (bubbles), may separate from the water and oil and fill the atmosphere in the space above the liquid phase layer. Water, oil, and gas can be tapped off periodically or continuously from their respective layers. Cyclonic separators are separators utilizing centrifugal force to effect separations of phases sufficiently close in density that separation by gravity separation is either ineffective or too time-consuming.

Conventional multi-phase separation equipment uphole is typically expensive, inefficient, and cumbersome. Examples of uphole separation devices include the devices disclosed in U.S. Pat. No. 7,147,788. In particular, conventional separation equipment is typically sized to process certain quantities and ratios of gas/oil and water/oil. Furthermore, conventional equipment is often bulky and poses additional environmental and safety hazards to personnel at the surface when separation operations are performed uphole.

SUMMARY

The present invention generally relates to devices and processes for downhole separation of mixtures of water, oil, and gas within well bores.

An example of a process for downhole separation of water, oil, and gas within a well bore in a formation, the well bore having a casing and the well bore extending from a surface, comprises: providing a packer in the casing so as to provide substantial fluid isolation between a first vertical section of the casing and a second vertical section of the casing; allowing a mixture from the formation to enter the first vertical section of the casing; allowing the mixture to form a gas phase and a first liquid mixture in the first vertical section wherein the gas phase comprises a gas and the first liquid mixture comprises a water and an oil; providing a pump, the pump having a pump intake in the first vertical section and having a pump discharge piping from the pump that extends through the packer to the second vertical section; pumping the first liquid mixture from the first vertical section through the pump discharge piping to the second vertical section so as to form a second liquid mixture in the second vertical section; allowing the second liquid mixture to form an oil phase and a water phase in the second vertical section wherein the water phase comprises water; providing an oil tubing that extends from the oil phase to the surface to allow for production of the oil; allowing the water from the water phase to be discharged outside of the casing to a water disposal zone in the formation; regulating an oil flow from the oil phase to the surface so as to substantially prevent the oil flow to the water disposal zone; providing a gas piping from the gas phase in the first vertical section to the surface to allow for a production of the gas to the surface; and regulating a gas flow from the gas phase in the first vertical section to the surface.

An example of a process for downhole separation of water, oil, and gas within a well bore in a formation, the well bore having a casing and the well bore extending from a surface, comprises: providing a first packer in the casing so as to provide substantial fluid isolation between a first vertical section of the casing and a second vertical section of the casing; allowing a mixture from the formation to enter the first vertical section of the casing; allowing the mixture to form a gas phase and a first liquid mixture in the first vertical section wherein the gas phase comprises a gas and the first liquid mixture comprises a water and an oil; providing a pump, the pump having a pump intake in the first vertical section and having a pump discharge piping from the pump that extends through the first packer to the second vertical section; pumping the first liquid mixture from the first vertical section through the pump discharge piping to the second vertical section so as to form a second liquid mixture in the second vertical section; allowing the second liquid mixture to form an oil phase and a water phase in the second vertical section wherein the water phase comprises water; providing an oil tubing that extends from the oil phase to the surface to allow for production of the oil; providing a second packer in the casing so as to substantially isolate the second vertical section of the casing from a third vertical section of the casing; providing a water tubing extending from the water phase of the second vertical section through the second packer to the third vertical section of the casing; allowing the water to flow from the water phase of the second vertical section through the water tubing to the third vertical section; allowing the water of the third vertical section to be discharged outside of the casing to a water disposal zone in the formation; regulating an oil flow from the oil phase to the surface so as to substantially prevent the oil flow to the water disposal zone; providing a gas piping from the gas phase in the first vertical section to the surface to allow for a production of the gas to the surface; and regulating a gas flow from the gas phase in the first vertical section to the surface.

An example of a process for downhole separation of water, oil, and gas within a well bore in a formation, the well bore having a casing and the well bore extending from a surface, comprises: providing a first packer in the casing so as to provide substantial fluid isolation between a first vertical section of the casing and a second vertical section of the casing; providing a second packer in the casing so as to provide substantial fluid isolation between a second vertical section of the casing and a third vertical section of the casing; allowing a mixture from the formation to enter the third vertical section of the casing; allowing the mixture to form a gas phase and a first liquid mixture in the third vertical section wherein the gas phase comprises a gas and the first liquid mixture comprises a water and an oil; providing a pump; the pump having a pump intake in the third vertical section and having a pump discharge piping from the pump that extends through the first packer and the second packer to the first vertical section; pumping the first liquid mixture from the third vertical section through the pump discharge piping to the first vertical section so as to form a second liquid mixture in the first vertical section; allowing the second liquid mixture to form an oil phase and a water phase in the first vertical section wherein the water phase comprises water; providing an oil tubing that extends from the oil phase to the surface to allow for production of the oil; providing a water tubing that extends from the water phase of the first vertical section through the first packer to the second vertical section; allowing the water in the second vertical section to be discharged outside of the casing to a water disposal zone in the formation; regulating an oil flow from the oil phase to the surface so as to substantially prevent the oil flow to the water disposal zone; providing a gas piping from the gas phase in the third vertical section to the surface to allow for a production of the gas to the surface; and regulating a gas flow from the gas phase in the third vertical section to the surface.

An example of a three phase separator system in a well bore having a casing extending through the well bore, the well bore extending from a surface comprises: a packer within the casing adapted to provide substantial fluid isolation between a first vertical section of the casing above the packer and a second vertical section of the casing below the packer; an oil production tubing from the second vertical section that extends to the surface; an oil valve inline with the oil tubing adapted to regulate an oil flow through the oil production tubing; a pump having a pump intake in the first vertical section and a pump discharge piping from the pump that extends through the packer to the second vertical section; a gas piping from the first vertical section to the surface adapted to allow the production of gas to the surface; and a gas valve inline with the gas piping adapted to regulate flow of gas through the gas piping.

An example of a process for downhole separation of three phases within a well bore in a formation, the well bore having a casing and the well bore extending from a surface, comprises: providing a packer in the casing so as to provide substantial fluid isolation between a first vertical section of the casing and a second vertical section of the casing; allowing a mixture from the formation to enter the first vertical section of the casing; allowing the mixture to form a first phase and a second phase in the first vertical section; providing a pump, the pump having a pump intake in the first vertical section and having a pump discharge piping from the pump that extends through the packer to the second vertical section; pumping the second phase from the first vertical section through the pump discharge piping to the second vertical section so as to form a third phase in the second vertical section; allowing the third phase to form a fourth phase and a fifth phase in the second vertical section; providing a tubing that extends from the fourth phase to the surface to allow for production from the fourth phase; allowing the fifth phase to be discharged outside of the casing to a disposal zone in the formation; regulating a fourth phase flow from the fourth phase to the surface so as to substantially prevent the fourth phase flow to the disposal zone; providing a piping from the first phase in the first vertical section to the surface to allow for a production from the first phase to the surface; and regulating a first phase flow from the first phase in the first section to the surface.

An example of a process for downhole separation of water, oil, and gas within a well bore in a formation, the well bore having a casing and the well bore extending from a surface, comprises: providing a first packer in the casing so as to provide substantial fluid isolation between a first vertical section of the casing and a second vertical section of the casing; providing a second packer in the casing so as to provide substantial fluid isolation between a second vertical section of the casing and a third vertical section of the casing; allowing a mixture from the formation to enter the third vertical section of the casing; allowing the mixture to form a gas phase and a first liquid mixture in the third vertical section wherein the gas phase comprises a gas and the first liquid mixture comprises a water and an oil; providing an oil tubing that extends from within the casing to the surface to allow for water-oil separation and for production of the oil; providing a pump, the pump having a pump intake in the third vertical section and having a pump discharge piping from the pump that extends into and terminates in the oil tubing; pumping the first liquid mixture from the third vertical section through the pump discharge piping to the oil tubing so as to form a second liquid mixture in the oil tubing; allowing the second liquid mixture to form an oil phase and a water phase in the oil tubing wherein the water phase comprises water; providing a gas bypass tubing that extends from the third vertical section to the first vertical section so as to allow gas from the gas phase of the third vertical section to flow from the third vertical section to the first vertical section; allowing the water from the water phase in the oil tubing to flow through an aperture in the oil tubing to the second vertical section so as to be discharged outside of the casing to a water disposal zone in the formation; regulating an oil flow from the oil phase to the surface so as to substantially prevent oil flowing to the water disposal zone; providing a gas piping from the gas phase in the first vertical section to the surface to allow for a production of the gas to the surface; and regulating a gas flow from the gas phase in the first vertical section to the surface.

The features and advantages of the present invention will be apparent to those skilled in the art. While numerous changes may be made by those skilled in the art, such changes are within the spirit of the invention.

BRIEF DESCRIPTION OF THE DRAWINGS

A more complete understanding of the present disclosure and advantages thereof may be acquired by referring to the following description taken in conjunction with the accompanying figures, wherein.

Figure 1:
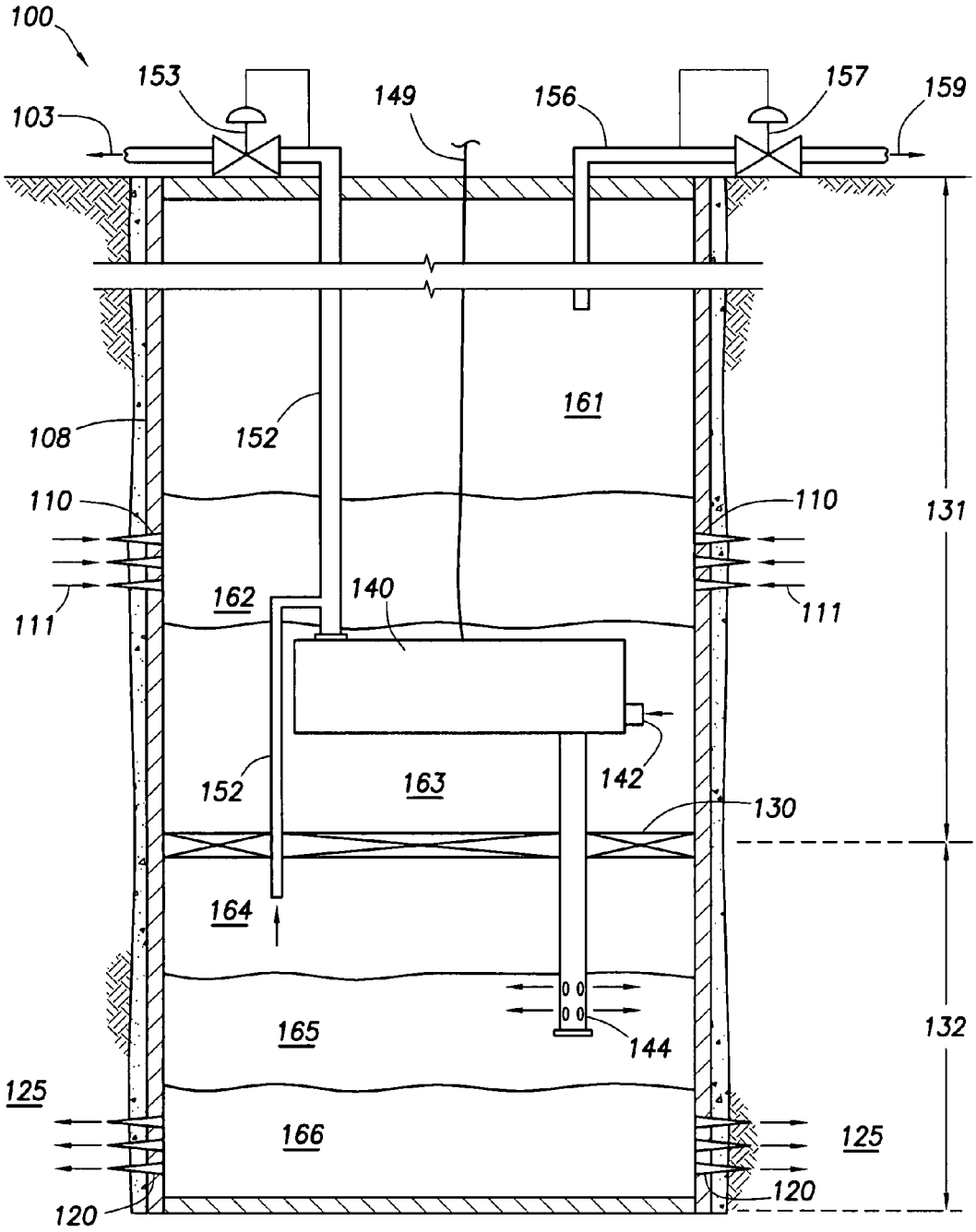
FIG. 1 shows a schematic illustration of a downhole separator system for separating mixtures into three phases utilizing oil-bypass tubing to bypass a pump in accordance with one embodiment of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF PREFERRED EMBODIMENTS

The present invention generally relates to devices and processes for downhole separation of mixtures of water, oil, and gas within well bores.

Generally, the present invention uses fluid isolation devices or packers to effect the downhole separation of three phase mixtures, such as the separation of water, various types of gases and oils. By utilizing two or more vertical sections of a downhole casing or tubing, gravity separation of multiple phases may be accomplished. For example, one vertical section of casing may be used to allow the gravity separation of a liquid mixture and a gas entrained therein while a second vertical section of casing may be used to separate the liquid mixture into a water phase and an oil phase. Numerous other components may form part of the separation system depending on the particular embodiment.

Advantages of the methods and devices of the present invention include, but are not limited to, a large range of scalability of the process across a wide range of gas/liquid and water/oil ratios, cost-effectiveness, environmental suitability, reduced safety risk to personnel, and the ability to efficiently accomplish downhole separation of production streams into water, gas, and oil.

To facilitate a better understanding of the present invention, the following examples of certain embodiments are given. In no way should the following examples be read to limit, or define, the scope of the invention.

FIG. 1 shows a schematic illustration of a downhole separator system for separating mixtures into three phases utilizing oil-bypass tubing in accordance with one embodiment of the present invention. Casing 108 extends through a subterranean formation. Although the well depicted here is a vertical well, deviated wells and in certain embodiments, horizontal wells are contemplated as within the scope of the present invention. Packer 130 substantially isolates casing 108 into first vertical section 131 and second vertical section 132.

The term "vertical section," as used herein, refers to any longitudinal portion or region of a casing in which gravity separation of two or more phases may be accomplished. The term "vertical section" explicitly includes the annular region between the casing and production tubing or in certain embodiments, an annular region between two nested sets of piping or conduits. The term "vertical section" in no way requires a non-deviated well or casing. Indeed, it is explicitly recognized that a vertical section of a well bore may vary in direction as the well bore direction varies with depth.

Perforations 110 in first vertical section 131 of casing 108 allow mixture 111 from the formation to enter casing 108. Mixture 111 comprises a combination of water and hydrocarbons. Typically, mixture 111 is a combination of water, oil, and gas, the gas being comprised of any combination of hydrocarbons, water vapor, and any myriad of chemical components that may exist in a gas phase under downhole conditions. The term "oil," as used herein, refers to any liquid hydrocarbon including, but not limited to, liquid hydrocarbons comprising non-carbon chemical components.

Under certain conditions, mixture 111 is present solely in a liquid phase in the formation and upon experiencing a pressure drop on account of mixture 111 entering casing 108, certain components of mixture 111 may vaporize so as to form a gas phase. Under other conditions, a portion of mixture 111 in the formation is already present in a gaseous form that is mixed or otherwise entrained in mixture 111.

Upon mixture 111 entering first vertical section 131 of casing 108, mixture 111 forms gas-liquid mixture 162. It is recognized that a portion of gas-liquid mixture 162 may include gases dissolved therein or otherwise in the process of separation. Gas-liquid mixture 162 separates to form gas phase 161 and liquid mixture 163. First vertical section 131 is of sufficient length to permit the separation of gas-liquid mixture 162 into gas phase 161 and liquid mixture 163.

Gas piping 156 provides a path to the surface for removal of gas from gas phase 161. Gas control valve 157 regulates the production of gas so as to maintain a desired backpressure in first vertical section 131.

Pump 140 drives liquid mixture 163 from first vertical section 131 via pump intake 142 through packer 130 to second vertical section 132 via pump discharge piping 144. Optional orifices in pump discharge piping 144 allow liquid mixture 163 to flow into mixed liquid phase 165.

Pump 140 may be any pump suitable to effect the transportation of liquid. Suitable pumps include, but are not limited to, electric submersible pumps, modified plunger rod pumps, progressive cavity pumps and more generally, centrifugal pumps and positive displacement pumps.

Second vertical section 132 is of sufficient length to allow gravity separation of mixed liquid phase 165 into oil phase 164 and water phase 166. Depending on downhole conditions, mixed liquid phase 165 may be present in second vertical section 132. Under certain conditions, mixed liquid phase 165 may not be a homogeneous phase, instead having a continuous gradient of a water/oil concentration from water phase 166 to oil phase 164.

Oil from oil phase 164 is removed via oil tubing 152. Oil tubing 152 may be comprised of one or more sections or tubing or piping as desired. In this embodiment, a portion of oil tubing 152 bypasses around pump 140. In certain embodiments, a portion of the tubing may be flexible tubing, and in further embodiments, ½" flexible tubing, particularly in those embodiments having small space constraints around pump 140. Also, it is recognized that a portion of oil tubing 152 may also provide structural support for pump 140 in addition to providing a conduit for oil flow from second vertical section 132 to the surface.

Oil control valve 153 regulates the flow of oil from second vertical section 132 so as to avoid or reduce entrainment of water from water phase 166 or from mixed liquid phase 165. The terminus of pump discharge piping 144 is preferably of sufficient vertical distance from the intake of oil tubing 152 to allow for the separation of oil from water so as to ensure that the oil being removed from oil phase 164 is substantially free of water or at least reduced to a desirably low concentration of water. Although oil tubing 152 is shown physically connected to pump 140, it is noted that this connection is merely a physical connection and that oil tubing 152 is not in fluid communication with pump 140 in this embodiment.

Perforations 120 in second vertical section 132 allow for water from water phase 166 to be discharged to water disposal zone 125. Preferably, perforations 120 are situated at a vertical distance from pump discharge piping 144 sufficient to allow for separation of oil from the water so as to reduce the quantity of oil being discharged to water disposal zone 125. It is recognized that, in certain configurations, a certain concentration of oil may be discharged to the water disposal zone.

Power conduit 149 allows for power distribution, for communication with system 100, and for the transmission of signals. For example, in certain embodiments, pump 140 may be electrically powered through power conduit 149 and controlled through signals sent via power conduit 149. Alternatively, system 100 may communicate with the surface or otherwise be controlled through signals from the surface as is known in the art (e.g. pulse-time modulation and coded sine wave signals of various frequencies). Power conduit 149 may be a rod string that powers pump 140, a conduit that delivers compressed gas that powers pump 140, a conduit that delivers high pressure liquid that powers pump 140, or any other source of power from the surface.

Figure 2:
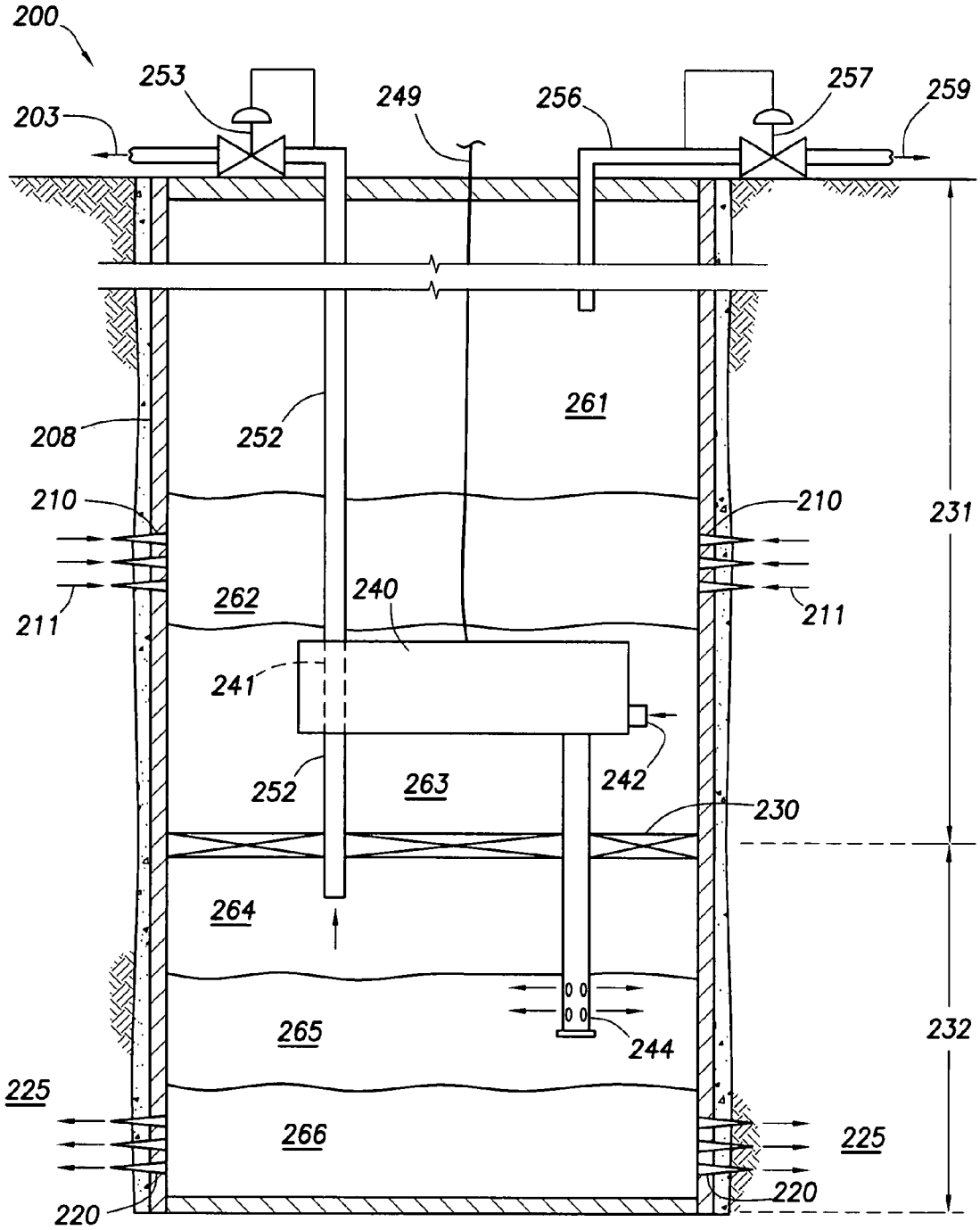
FIG. 2 shows a schematic illustration of a downhole separator system for separating mixtures into three phases utilizing an oil-bypass cavity in accordance with one embodiment of the present invention.

FIG. 2 shows a schematic illustration of a downhole separator system for separating mixtures into three phases utilizing an oil-bypass cavity in accordance with one embodiment of the present invention. The embodiment depicted in FIG. 2 is similar to the embodiment depicted in FIG. 1, except that oil-bypass cavity 241 is provided in pump 240 through which oil tubing 252 may bypass oil through the pump body with substantially no change in the pressure of the oil. In this way, oil tubing 252 may bypass "straight through" pump 240 without having to be routed around pump 240. Oil-bypass cavity 241 is especially adapted to configurations in which sufficient space is unavailable for routing oil tubing 252 around pump 240.

Although packer 230 is shown as disposed within casing 208, it is recognized that packer 230 may be installed inline with casing 208, for example as a component between two sections of casing. Packer 230 may be any device suitable for substantially isolating fluid flow from one section of casing to another section of casing.

The term "gas," as used herein, refers to any chemical component that exists in the gas state (i.e. not liquid and not solid) under relevant downhole conditions regardless of the identity of the chemical substance. Thus, the gas of gas phase 261 may include methane, water vapor, ethane, propane, any other substance that exists as a gas in the environment of gas phase 261, or any combination thereof. The inclusion of a small quantity of liquid or even solids in all or a portion of gas phase 261 is contemplated under certain embodiments and does not exclude such a phase from being considered a gas phase when such a phase is substantially free of entrained liquid. Entrained liquids can result in gas piping 256 due to (1) high gas velocities and insufficient vertical distance between the intake of gas piping 256 and gas-liquid mixture 262, (2) condensation of certain components due to pressure drop across gas piping 256, or (3) a change in temperature along gas piping 256.

Furthermore, it is recognized that the water referred to herein includes any water contained in mixture 211. Sources of water include, but are not limited to, naturally occurring formation water, artificially introduced water, including injected water from secondary recovery operations, or any combination thereof.

The terms "tubing" and "piping" as used herein refer to any conduit through which fluid may flow and both terms are used interchangeably herein.

In certain embodiments, chemical additives or agents may be introduced into first vertical section 231 or second vertical section 232, as desired, to enhance separation of gases from liquids in first vertical section 231, to enhance separation of oil and water in second vertical section 232, to address downhole problems such as foaming, to perform desired pre-processing steps to downhole components, or any combination thereof. Suitable examples include, but are not limited to, surfactants, emulsion breakers, wetting agents, dispersants, detergents, defoaming agents, pH adjusting compounds, corrosion inhibitors, or any combination thereof.

Figure 3:
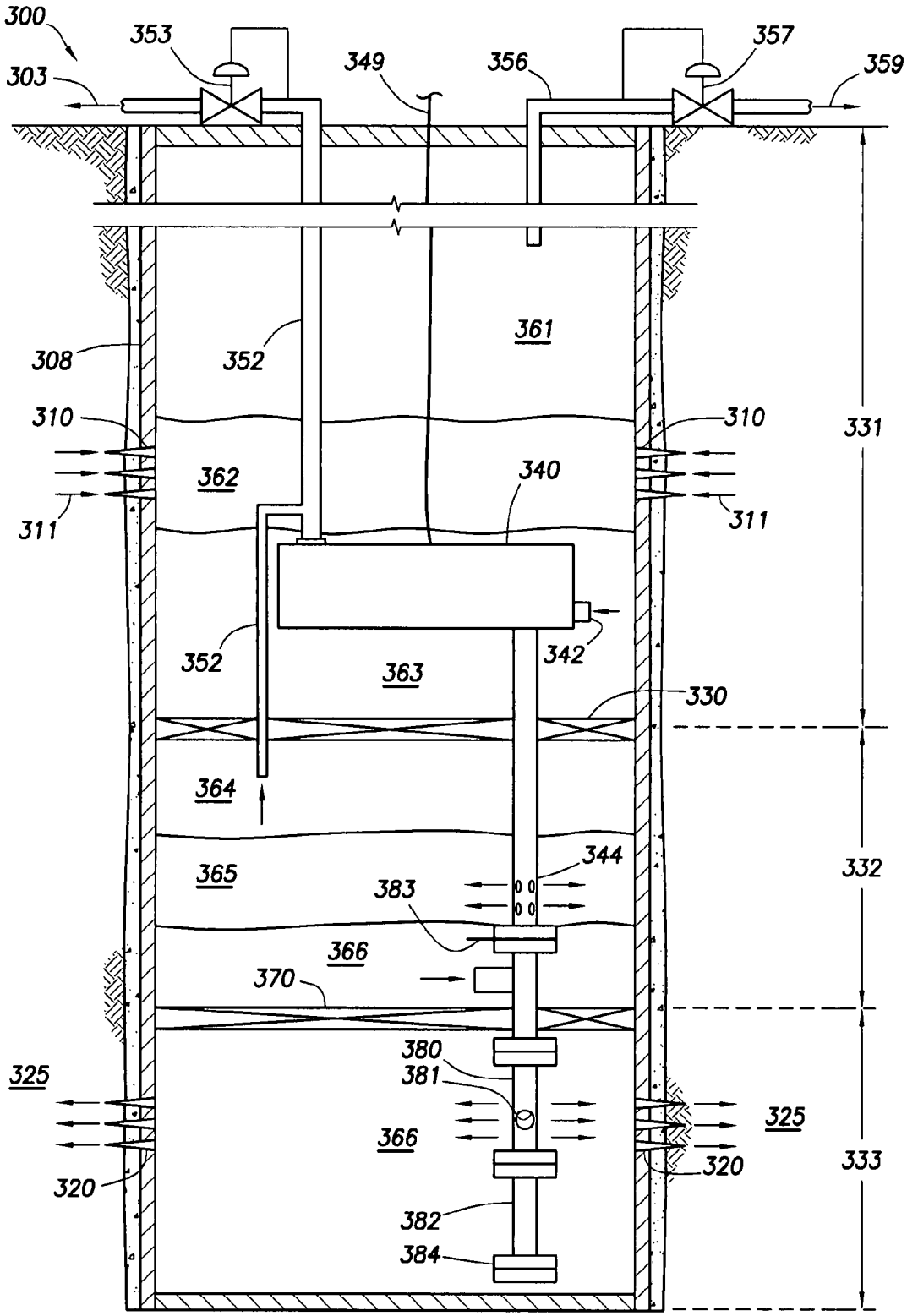
FIG. 3 shows a schematic illustration of a downhole separator system for separating mixtures into three phases utilizing oil-bypass tubing, an orifice, and a plurality of packers in accordance with one embodiment of the present invention.

FIG. 3 shows a schematic illustration of a downhole separator system for separating mixtures into three phases utilizing oil-bypass tubing, an orifice, and a plurality of packers in accordance with one embodiment of the present invention. First packer 330 and second packer 370 substantially isolate casing 308 into first vertical section 331, second vertical section 332, and third vertical section 333.

Perforations 310 in first vertical section 331 of casing 308 allow mixture 311 from the formation to enter casing 308. Upon mixture 311 entering first vertical section 331 of casing 308, mixture 311 forms gas-liquid mixture 362. Gas-liquid mixture 362 separates to form gas phase 361 and liquid mixture 363. Gas piping 356 provides a path to the surface for removal of gas from gas phase 361. Gas control valve 357 regulates the production of gas so as to maintain a desired backpressure in first vertical section 331.

Pump 340 drives liquid mixture 363 from first vertical section 331 via pump intake 342 through packer 330 to second vertical section 332 via pump discharge piping 344. Second vertical section 332 is of sufficient length to allow gravity separation of mixed liquid phase 365 into oil phase 364 and water phase 366.

Oil from oil phase 364 is removed via oil tubing 352. Oil control valve 353 regulates the flow of oil from second vertical section 332 so as to avoid or reduce entrainment of water from water phase 366 or from mixed liquid phase 365.

Water tubing 380 allows water from water phase 366 to pass from second vertical section 332 through second packer 370 to third vertical section 333. Orifice 381 provides a flow restriction sufficient to regulate the flow of water from second vertical section 332 to third vertical section 333 so as to reduce the amount of oil entrained with the water. Although water tubing 380 is physically connected to pump discharge piping 344, water tubing 380 is not in fluid communication with pump discharge piping 344 in this embodiment. Blind 383 prevents fluid communication between water tubing 380 and pump discharge piping 344.

Perforations 320 in third vertical section 333 allow for water from water phase 366 to be discharged to water disposal zone 325. Water tubing 380 is shown here with optional end trap 382 for accumulation of trash or other sediment. End trap 382 with blind 384 may be used as desired to accumulate sediment and trash.

Figure 4:
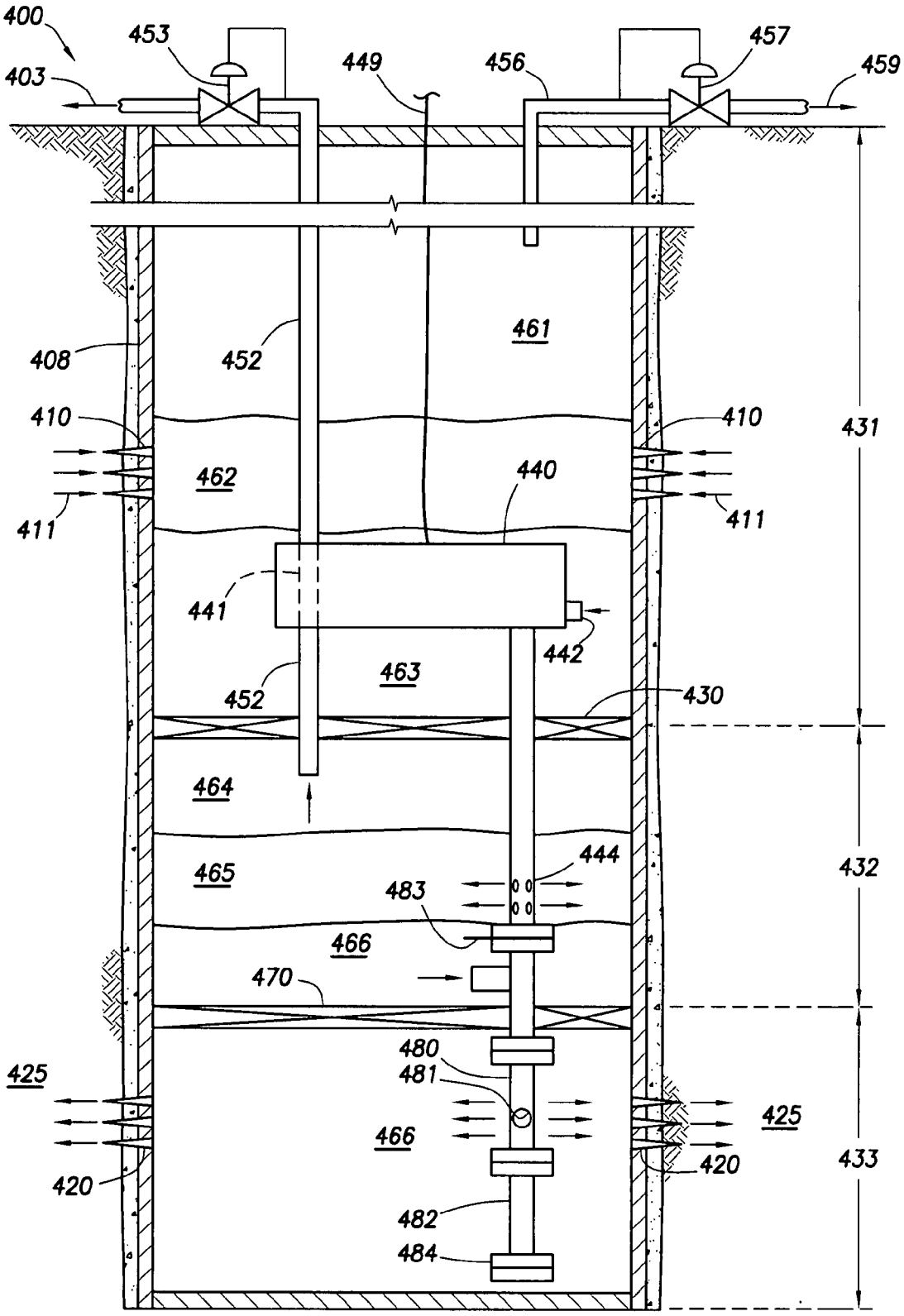
FIG. 4 illustrates the downhole separator system of FIG. 3 utilizing an oil-bypass cavity, an orifice, and a plurality of packers in accordance with one embodiment of the present invention.

FIG. 4 illustrates the downhole separator system of FIG. 3 utilizing an oil-bypass cavity, an orifice, and a plurality of packers in accordance with one embodiment of the present invention. Here, oil bypass cavity 441 allows the routing of oil tubing 452 through pump 440.

Additionally, pump discharge piping 444 is physically attached to water tubing 480, but blind 483 provides fluid isolation between pump discharge piping 444 and water tubing 480. Here, second pump 445, is optionally added to water tubing 480, which in certain embodiments may be a variable speed pump so as to regulate the flow of water from second vertical section 432 to third vertical section 433. Second pump 445 may be used instead of or in conjunction with orifice 481 as desired.

The methods and devices herein may be combined with additional finishing steps and processes uphole (not shown) to provide additional phase separation, which may be necessitated by differing uphole or downhole conditions.

Figure 5:
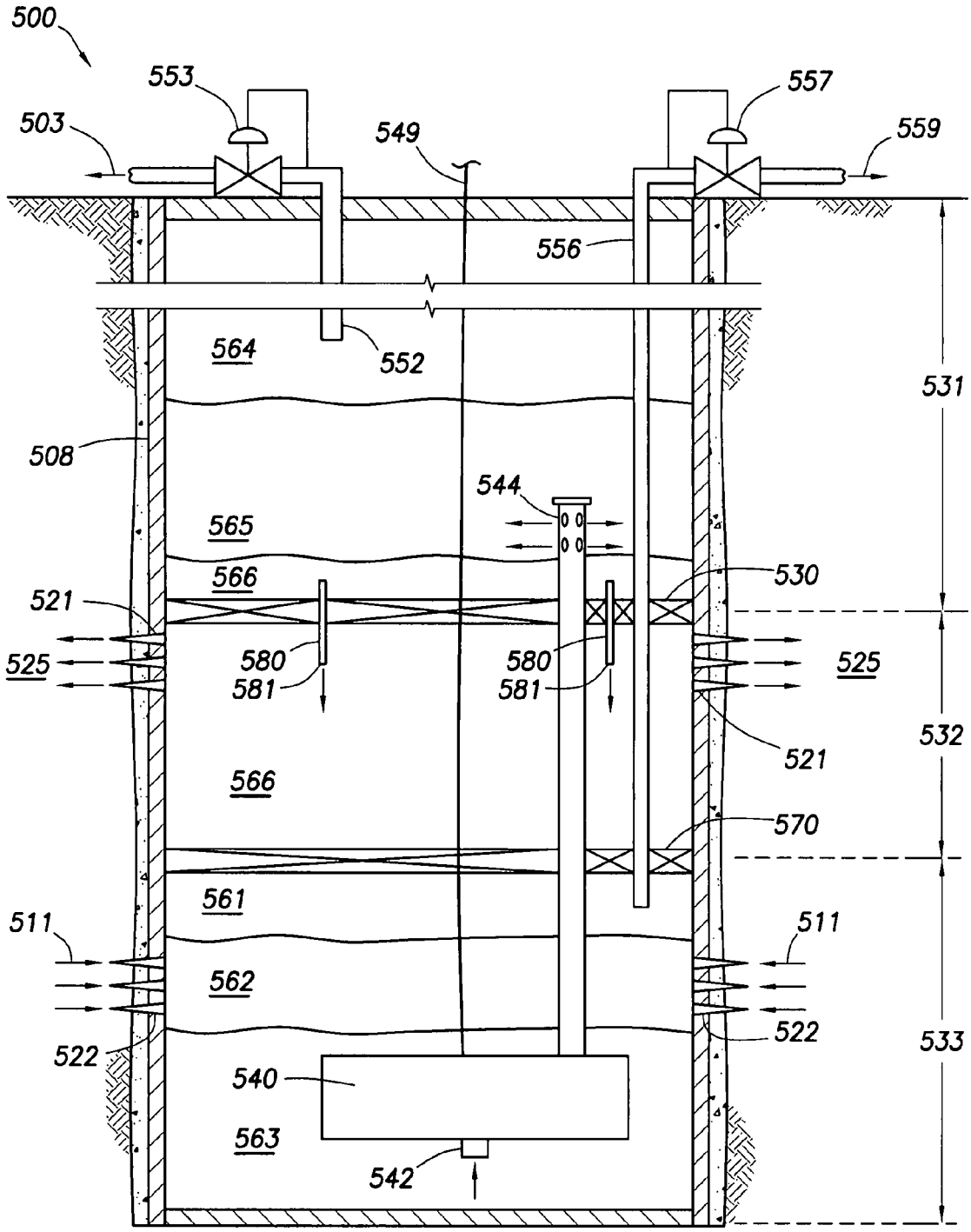
FIG. 5 shows a schematic illustration of an alternate embodiment of a downhole separator system for separating mixtures into three phases, having an upward pump discharge.

FIG. 5 shows a schematic illustration of an alternate embodiment of a downhole separator system for separating mixtures into three phases, having a top upward discharge from pump 540.

Packer 530 and packer 570 substantially isolate casing 508 into first vertical section 531, second vertical section 532, and third vertical section 533. Perforations 522 in third vertical section 533 of casing 508 allow mixture 511 from the formation to enter casing 508.

Upon mixture 511 entering third vertical section 533 of casing 508, mixture 511 forms gas-liquid mixture 562. Gas-liquid mixture 562 separates to form gas phase 561 and liquid mixture 563. Gas piping 556 provides a path to the surface for removal of gas from gas phase 561. Gas control valve 557 regulates the production of gas so as to maintain a desired backpressure in third vertical section 533. A plurality of gas control valves may be used to manipulate a control parameter or variable such as gas flow, level, and pressure control as desired.

Pump 540 drives liquid mixture 563 from third vertical section 533 via pump intake 542 through packers 530 and 570 to first vertical section 531 via pump discharge piping 544. First vertical section 531 is of sufficient length to allow gravity separation of mixed liquid phase 565 into oil phase 564 and water phase 566.

Oil from oil phase 564 is removed via oil tubing 552. Oil control valve 553 regulates the flow of oil from first vertical section 531. Again, a plurality of oil control valves may be used to manipulate a control parameter or variable such as oil flow, level, and pressure control as desired. Although oil phase 564 is depicted as extending to the surface in this embodiment, FIG. 5 in no way requires oil phase 564 to extend to the surface.

Plurality of water tubing 580 allows for the flow of water from water phase 566 through packer 530 to second vertical section 532. It is explicitly recognized that water tubing 580 may be comprised of a plurality of water tubing or a single tubing. Orifice 581 in water tubing 580 regulates the water flow from first vertical section 531 to second vertical section 532. Perforations 521 in second vertical section 532 allow for water from water phase 566 to be discharged to water disposal zone 525.

Figure 6:
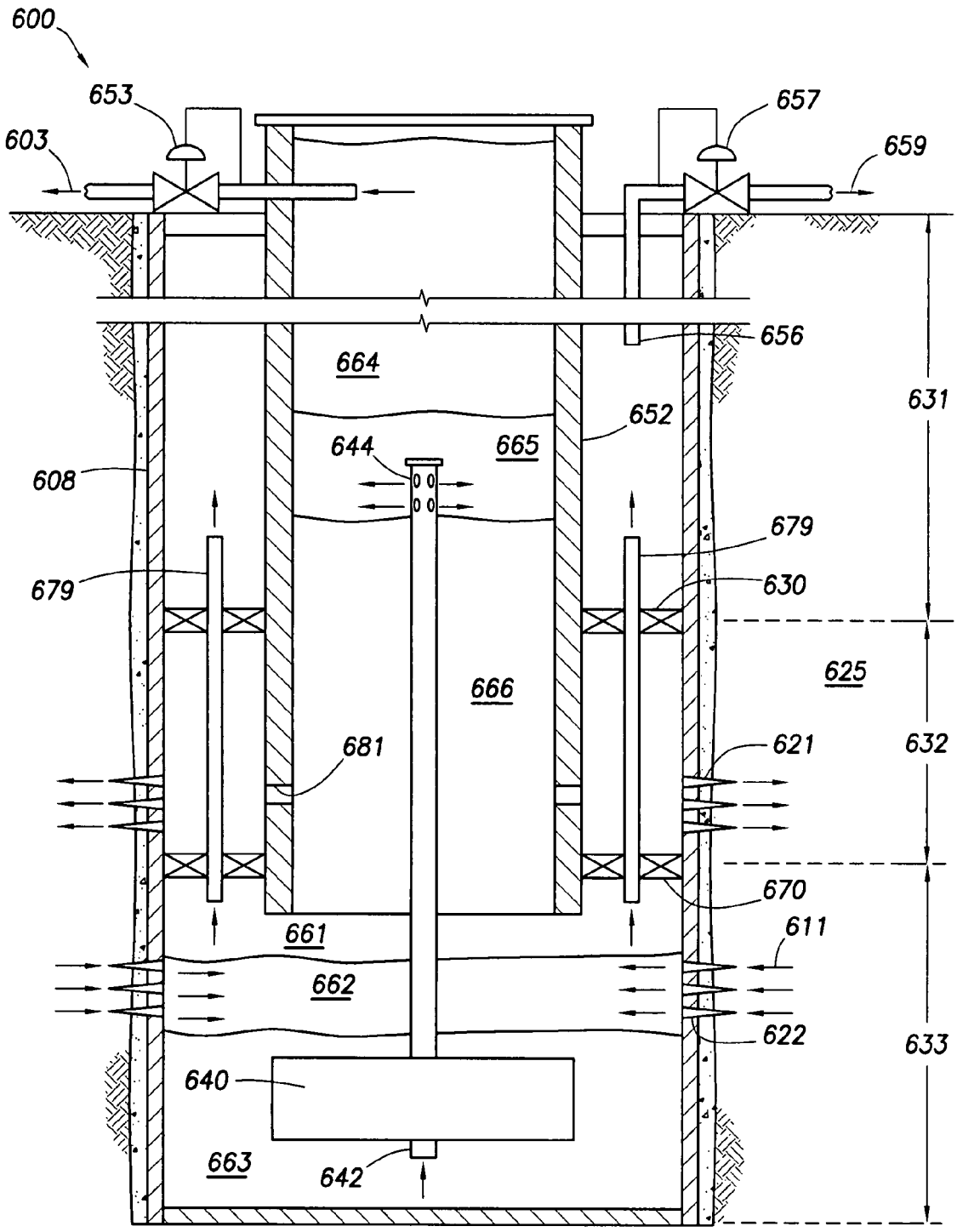
FIG. 6 shows a schematic illustration of an alternate embodiment of a downhole separator system for separating mixtures into three phases, having an upward pump discharge and utilizing gas bypass piping.

FIG. 6 shows a schematic illustration of an alternate embodiment of a downhole separator system for separating mixtures into three phases, having an upward pump discharge and utilizing gas bypass piping.

Packers 630 and 670 substantially isolate casing 608 into first vertical section 631, second vertical section 632, and third vertical section 633. Perforations 622 in third vertical section 633 of casing 608 allow mixture 611 from the formation to enter casing 608.

Upon mixture 611 entering third vertical section 633 of casing 608, mixture 611 forms gas-liquid mixture 662. Gas-liquid mixture 662 separates to form gas phase 661 and liquid mixture 663.

Gas bypass tubing 679 provides a path to first vertical section 631. Gas piping 656 allows for removal of gas from first vertical section 631. Gas control valve 657 regulates the production of gas so as to maintain a desired backpressure in first vertical section 631. It is explicitly recognized that gas piping 679 could in certain embodiments be directly connected to gas piping 656. A plurality of gas control valves may be used to manipulate a control parameter or variable such as gas flow, level, and pressure control as desired.

Pump 640 drives liquid mixture 663 from third vertical section 633 via pump intake 642 to pump discharge piping 644. Oil tubing 652 is of sufficient length to allow gravity separation of mixed liquid phase 665 into oil phase 664 and water phase 666. Although in this illustration, pump discharge piping 644 is shown terminating in the region corresponding to first vertical section 631, it is recognized that pump discharge tubing could terminate at any location in oil tubing 652 that is sufficient to allow separation of mixed liquid phase 665 into oil phase 664 and water phase 666 in oil tubing 652.

Oil from oil phase 664 is removed from oil tubing 652 via oil control valve 653, which regulates the flow of oil from oil tubing 652. Again, a plurality of oil control valves may be used to manipulate a control parameter or variable such as oil flow, level, and pressure control as desired.

One or more orifices 681 in oil tubing 652 allow water from water phase 666 to flow into second vertical section 632. Perforations 621 in second vertical section 632 allow for water from water phase 666 to be discharged to water disposal zone 625. It is explicitly recognized that orifices 681 may be any aperture suitable for limiting water flow, including, but not limited to, perforations, orifices, specialized nozzles, or any combination thereof.

It is explicitly recognized that elements depicted in any one of the FIGS. 1-6 shown herein may be incorporated into any of the other embodiments. For example, regulator valves and/or the variable speed pump depicted in FIG. 5 may be incorporated into any other embodiment. Likewise, the additional piping and packers shown in FIGS. 2 and 4 may be incorporated into any of the other embodiments as desired.

Furthermore, it is explicitly recognized that the three phase separator system shown herein may be combined with additional separation processes uphole such as other gravity separators, cyclonic separators, centrifugal separators, flash drums, other finishing steps, or any combination thereof.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A process for downhole separation of water, oil, and gas within a well bore in a formation, the well bore having a casing and the well bore extending from a surface, comprising:

providing a packer in the casing so as to provide substantial fluid isolation between a first vertical section of the casing and a second vertical section of the casing;

allowing a mixture from the formation to enter the first vertical section of the casing;

allowing the mixture to form a gas phase and a first liquid mixture in the first vertical section wherein the gas phase comprises a gas and the first liquid mixture comprises a water and an oil;

providing a pump, the pump having a pump intake in the first vertical section and having a pump discharge piping from the pump that extends through the packer to the second vertical section;

pumping the first liquid mixture from the first vertical section through the pump discharge piping to the second vertical section so as to form a second liquid mixture in the second vertical section;

allowing the second liquid mixture to form an oil phase and a water phase in the second vertical section wherein the water phase comprises water;

providing an oil tubing that extends from the oil phase to the surface to allow for production of the oil;

allowing the water from the water phase to be discharged outside of the casing to a water disposal zone in the formation;

regulating an oil flow from the oil phase to the surface so as to substantially prevent the oil flow to the water disposal zone;

providing a gas piping from the gas phase in the first vertical section to the surface to allow for a production of the gas to the surface; and regulating a gas flow from the gas phase in the first vertical section to the surface.

2. The method of claim 1 wherein the first vertical section is above the packer and wherein the second vertical section is below the packer.

3. The method of claim 2 further comprising perforating the casing in the second vertical section to allow the water to be discharged to the water disposal zone.

4. The method of claim 3 wherein the pump further comprises a bypass cavity in the pump to allow the oil flow to pass through the pump from the second vertical section to the surface.

5. The method of claim 3 further comprising providing a gas valve inline with the gas tubing and regulating the gas flow with the gas valve so as to maintain a back pressure.

6. The method of claim 3 further comprising providing a gas valve inline with the gas tubing and wherein the gas valve regulates a control parameter wherein the control parameter is the gas flow, a level, or the back pressure.

7. The method of claim 3 further comprising providing an oil valve inline with the oil tubing and regulating the oil flow with the oil valve.

8. The method of claim 3 further comprising providing an oil valve inline with the oil tubing and regulating a control parameter wherein the control parameter is a level or a pressure.

9. The method of claim 2 further comprising regulating an oil flow from the oil phase to the surface so as to maintain the first interface above an outlet of the pump discharge piping.

10. The method of claim 1 wherein the second vertical section is above the packer and wherein the first vertical section is below the packer.

11. The method of claim 1 further comprising perforating the casing in the first vertical section to allow the mixture to flow from the formation into the casing.

12. The method of claim 1 further comprising regulating an oil flow from the oil phase to the surface so as to maintain the oil phase level below an inlet of the oil tubing.

13. The method of claim 1 wherein the step of allowing the second liquid mixture to form an oil phase and a water phase in the second vertical section is assisted by an introduction of an additive wherein the additive is a surfactant or an emulsion-breaking chemical to assist a gravity separation of the phases.

14. The method of claim 1 further comprising:

providing a gas valve inline with the gas tubing and regulating the gas flow with the gas valve so as to maintain a back pressure; and providing an oil valve inline with the oil tubing and regulating the flow of the oil with the oil valve.

15. A three phase separator system in a well bore having a casing extending through the well bore, the well bore extending from a surface comprising:

a packer within the casing adapted to provide substantial fluid isolation between a first vertical section of the casing above the packer and a second vertical section of the casing below the packer;

an oil production tubing from the second vertical section that extends to the surface;

an oil valve inline with the oil tubing adapted to regulate an oil flow through the oil production tubing;

a pump having a pump intake in the first vertical section and a pump discharge piping from the pump that extends through the packer to the second vertical section;

a gas piping from the first vertical section to the surface adapted to allow the production of gas to the surface; and a gas valve inline with the gas piping adapted to regulate flow of gas through the gas piping.

16. The three phase separator device of claim 15 wherein the casing further comprises perforations in the first vertical section of the casing adapted to allow a mixture to flow from the formation into the annulus of the first vertical section of the casing and wherein the casing further comprises perforations in the casing of the second vertical section adapted to allow the water to be discharged to the water disposal zone.

17. The three phase separator device of claim 16 wherein the pump is a variable speed pump.

18. The three phase separator device of claim 16 further comprising:

a gas valve inline with the gas tubing adapted to regulate the gas flow with the gas valve so as to maintain a back pressure; and an oil valve inline with the oil production tubing adapted to regulate the oil flow with the oil valve.

19. A process for downhole separation of three phases within a well bore in a formation, the well bore having a casing and the well bore extending from a surface, comprising:

providing a packer in the casing so as to provide substantial fluid isolation between a first vertical section of the casing and a second vertical section of the casing;

allowing a mixture from the formation to enter the first vertical section of the casing;

allowing the mixture to form a first phase and a second phase in the first vertical section;

providing a pump, the pump having a pump intake in the first vertical section and having a pump discharge piping from the pump that extends through the packer to the second vertical section;

pumping the second phase from the first vertical section through the pump discharge piping to the second vertical section so as to form a third phase in the second vertical section;

allowing the third phase to form a fourth phase and a fifth phase in the second vertical section;

providing a tubing that extends from the fourth phase to the surface to allow for production from the fourth phase;

allowing the fifth phase to be discharged outside of the casing to a disposal zone in the formation;

regulating a fourth phase flow from the fourth phase to the surface so as to substantially prevent the fourth phase flow to the disposal zone;

providing a piping from the first phase in the first vertical section to the surface to allow for a production from the first phase to the surface; and regulating a first phase flow from the first phase in the first section to the surface.

* * * * *